United States Patent [19]

Bell

[11] 4,329,790

[45] May 18, 1982

[54] BOOT WITH ANGULARLY EXTENDING CLEATS

[76] Inventor: Michael Bell, P.O. Box 400, Warrington, Pa. 18976

[21] Appl. No.: 134,405

[22] Filed: Mar. 27, 1980

[51] Int. Cl.[3] ..... A43B 13/04; A43B 1/10; A43B 23/28

[52] U.S. Cl. ..... 36/32 R; 36/4; 36/59 C; D2/320

[58] Field of Search ..... 36/32 R, 59 R, 59 B, 36/59 C, 4, 67 R, 67 A; D2/319, 320, 321

[56] References Cited

U.S. PATENT DOCUMENTS

| | | | |
|---|---|---|---|
| D. 213,415 | 3/1969 | Meadows | D2/320 |
| 1,560,995 | 11/1925 | Kaplan | 36/59 C |
| 2,236,278 | 3/1941 | Tousley | 36/59 C |
| 2,570,949 | 10/1951 | Hoffenberg | 36/59 C |
| 3,061,952 | 11/1962 | Prohaska | 36/59 C |
| 4,160,331 | 7/1979 | Bell | 36/59 B |
| 4,241,524 | 12/1980 | Sink | 36/59 C |

FOREIGN PATENT DOCUMENTS

| | | | |
|---|---|---|---|
| 520903 | 7/1953 | Belgium | 36/4 |
| 770692 | 7/1934 | France | 36/67 A |
| 2402425 | 4/1979 | France | 36/32 R |
| 131425 | 8/1919 | United Kingdom | 36/59 C |

OTHER PUBLICATIONS

Rubber Footwear, Hood Rubber Company, Watertown, Mass. 1948, p. 3.

*Primary Examiner*—James Kee Chi

*Attorney, Agent, or Firm*—Caesar, Rivise, Bernstein & Cohen, Ltd.

[57] ABSTRACT

An overboot arranged to be worn over a shoe or other footwear and formed as an integral unit. The overboot includes an upper portion, a sole portion and a heel portion. The sole portion includes plural elongated cleats extending across the full width of the sole and comprising raised members having grooves therein. Plural undulating ridges project up slightly from the grooves. The space between adjacent cleats is in the form of grooves. Each of the cleats is disposed at a predetermined angle to the longitudinal axis of the sole. The angle is approximately the angle made with the axis by a line extending from the second to the fifth metatarsal head of the wearer's foot to facilitate the flexure of the sole as the wearer walks in the boot, while providing for good traction and the releasement of soft adhering materials, such as mud, slush, snow, etc., from the boot sole.

16 Claims, 4 Drawing Figures

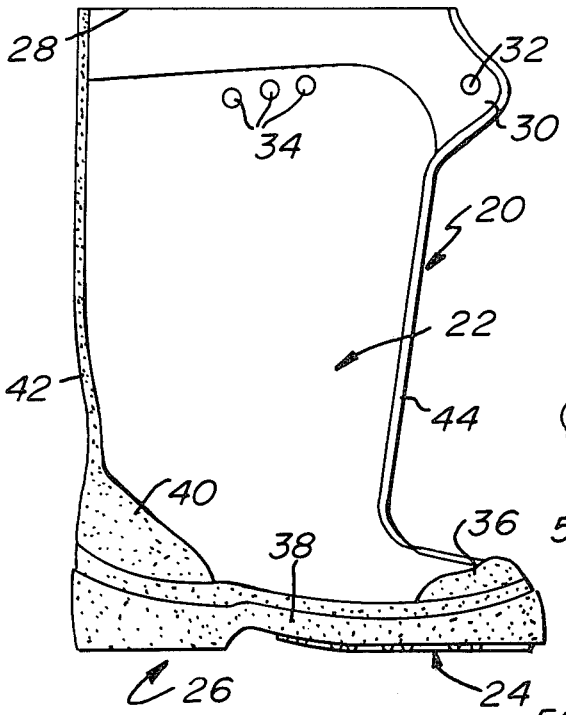
FIG. 1
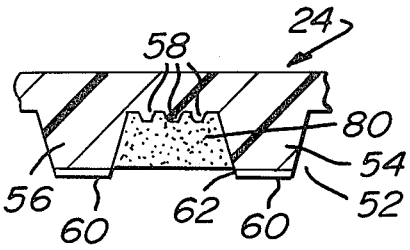
FIG. 4
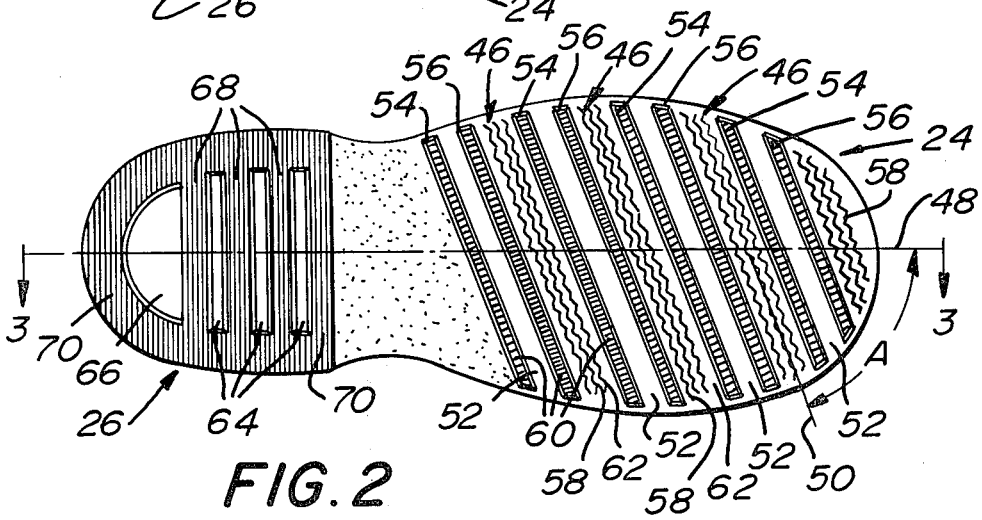
FIG. 2
FIG. 3
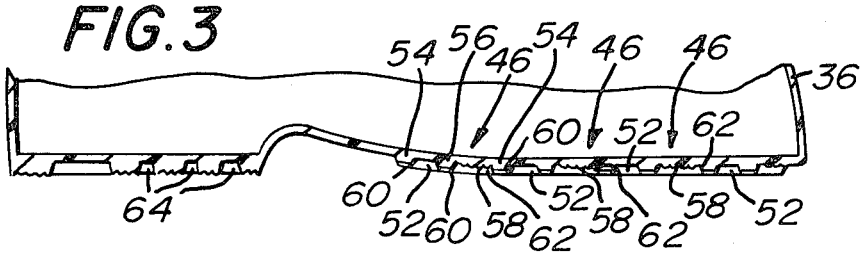

BOOT WITH ANGULARLY EXTENDING CLEATS

This invention relates generally to footwear and more particularly to waterproof overboots.

The various overboots for use in water, snow, slush, mud, etc. are commercially available. Such boots while serving to keep a wearer's foot dry, nevertheless exhibit various disadvantages. For example, boots which are sufficiently flexible so as not to hinder walking have not proved sufficiently rugged for heavy-duty applications. While heave-duty boots are suitable for such applications, such boots frequently are relatively stiff, do not provide the maximum traction and have a tendency to clog up with soft material, such as mud, snow, slush, etc. thereby further limiting their usefulness for traction.

The patent literature contains various disclosures of footwear including soles having various types of cleats for engaging the ground. For example, the U.S. Pat. to Haylock, No. 328,777 discloses in a leather boot, a rubber sole formed of a plurality of transverse cleats extending at an angle to the longitudinal axis of the boot. The grooves between the cleats are designed to increase the hold of the boot. However, owing to the construction of the boot, it appears to be extremely inflexible and to exhibit the tendency to clog up with soft material, such as mud, snow, or slush.

The patent to Bingham, Jr. U.S. Pat. No. 3,198,864 discloses a molded waterproof overboot whose sole includes plural transversely extending cleats. While the boot shown in the Bingham U.S. Pat. No. 3,198,864 appears to be substantially more flexible than that of the Haylock patent, it appears to also have the tendency to clog with soft material.

In Design Patent No. 235,283 there is shown a knee boot whose bottom is similar in construction to that of the Bingham, Jr. U.S. Pat. No. 3,198,864 i.e., includes plural transversely extending cleats, and thus would suffer from similar drawbacks.

Accordingly, it is the general object of the instant invention to provide a waterproof overboot which overcomes the disadvantages of the prior art.

It is the further object of the instant invention to provide a waterproof overboot which is molded of resilient material and having a sole constructed to facilitate flexure and traction while providing for effective release of adhering soft material as the user walks.

These and other objects of the instant ivention are achieved by providing a waterproof overboot arranged to be worn over other footwear and formed as an integral unit including an upper portion, a sole portion and a heel portion. The sole portion includes plural elongated cleats extending across the full width of the sole portion and comprising raised members having grooves therein. The space between the adjacent cleats is in the form of a substantial depth groove. Each of the cleats is disposed at a predetermined angle to the longitudinal axis of the sole portion, with the angle being approximately the angle made with said axis by a line extending from the second to the fifth metatarsal head of the wearer's foot.

Other objects and many of the attendant advantages of this invention will be readily appreciated as the same becomes better understood by reference to the following detailed description when considered in connection with the accompanying drawing wherein:

FIG. 1 is a side elevational view of a boot constructed in accordance with the instant invention;

FIG. 2 is an enlarged bottom plan view of the boot shown in FIG. 1;

FIG. 3 is a sectional view taken along line 3—3 of FIG. 2; and

FIG. 4 is a greatly enlarged sectional view of a portion of the sole of the boot of the instant invention showing an alternative embodiment thereof.

Referring now in greater detail to the various figures of the drawing wherein like reference characters refer to like parts, there is shown generally a 20 in FIG. 1 an overboot constructed in accordance with the instant invention.

The overboot 20 is arranged to be worn over a shoe or other footwear and is preferably formed as an integral unit, such as by molding, or rubber, plastic or other suitable resilient material. The boot basically comprises an upper or leg portion 22, a sole portion 24 and a heel portion 26.

The upper is a tubular member which is gently flared upward to an open mouth 28. The sidewall forming the upper includes a projecting portion 30 contiguous with the mouth and which forms a flap for closing the boot's upper tightly about the leg of the wearer. To that end, releasable securement means in the form of a snap socket 32 is mounted on the flap portion 30 for selective engagement with one of a plurality of mating snap heads 34 disposed on the side of the upper of the boot adjacent the mouth.

The sidewall forming the upper in the toe 36 area, along the periphery 38 of the sole, in the heel counter area 40, along a vertically extending back area 42 and along a vertically extending front area 44, is thicker than the remaining portion of the boot's sidewall in the interest of ruggedness and durability. In a similar manner, the sidewall of the boot contiguous with the mouth 28 of the upper portion is also of greater thickness than the remaining portion of the upper portion since the mouth of the boot is subject to substantial stresses as the boot is tightened about the leg of the wearer.

Referring now to FIG. 2, there is shown in detail the construction of the sole 24. As can be seen therein, the sole 24 basically comprises a plurality of cleats 46. The cleats extend the full width of the sole, that is, from the valgus side to the varus side. In accordance with the teachings of the invention, the cleats are oriented at an angle A with respect to the longitudinal axis 48 of the sole. The angle A is approximately equal to the angle made by a line, designated by the reference numeral 50, connecting the second and fifth metatarsal heads of the wearer's foot (not shown) with respect to the longitudinal axis 48.

As can be seen in FIGS. 2 and 3, immediately adjacent cleats 46 are separated from one another by relatively deep grooves 52. The grooves extend the full width of the sole between the varus and valgus sides thereof. The cleats 46 basically comprise three elements, namely, a forward edge or ridge 54, a rear edge or ridge 56 spaced from the forward edge and three short height undulating ridges 58 extending therebetween. The ridges 54 and 56 are generally linear members whose top surface includes a plurality of closely spaced shallow serrations 60 disposed perpendicularly to the length of the ridge. The space between the ridges 54 and 56 forms a groove 62 from which the undulating ridges 58 project.

The undulating ridges 58, as seen in FIG. 2, extend generally linearly and parallel to the ridges 54 and 56 with each ridge 58 being formed of plural zig-zag legs. The three ridges 58 are disposed parallel with one another in a nested array.

If it is desired to provide even greater traction, a grit type material can be located within the recess 62 in each cleat as shown in FIG. 4 and in accordance with the teachings of my U.S. Pat. No. 4,160,331. In such a construction, the undulating ridges 58 aid in the retention of the grit body 80 within the recess 62.

The angled orientation of the cleats is of considerable importance to facilitate traction by keeping substantial portions of the sole in contact with the ground during flexing while also effecting the automatic release of soft materials, e.g., mud, slush, etc., which would otherwise adhere to the sole in messy conditions. The automatic releasing action of the sole occurs as follows: since the adhering material is located within angularly extending recesses, e.g., 52, in the sole, flexure of the sole, which during walking occurs along a transverse axis perpendicular to longitudinal axis 48, produces a twisting action on the cleats and concomittant shear forces on the adhering material. Accordingly, the material breaks away from the sole.

The heel 26 includes a plurality of deep wells 64 extending generally transversely to the longitudinal axis 48. The wells 64 each extend for a substantial width of the heel portion. A semicircular shaped well 66, of the same depth as well 64, is located to the rear of the heel portion 26. The size and disposition of the wells 64 and 66 form a plurality of ground engaging cleats 68 therebetween and a peripherally extending ground engaging portion 70.

In accordance with the preferred aspect of the invention, the boot 20 is molded of a PVC compound in the interest of light weight, high resiliency, flexibility and ruggedness.

As will be appreciated from the foregoing, the overboot of the instant invention is simple in construction, and can be made at relatively low cost. The ridges 58 in the grooves 62 make those grooves shallower than the grooves 52 separating adjacent cleats. This feature enables the overboot to be effective in a wide variety of ground surface conditions. To that end, the grooves with the undulating ridges provides maximum contact and also provide a holding area for grit like that disclosed in my aforenoted patent, while the deep grooves between the cleats provide sufficient bite into soft surfaces, such as snow, mud, and sand to maximize traction in such conditions. The feature of the angle of the cleats being approximately equal to the angle between the longitudinal axis of the boot and the line connecting second and fifth metatarsal heads of the wearer's foot effectuates the release of soft surfaces from the sole as the sole flexes when the foot is lifted to take a step and also facilitates the flexing action of the boot, thereby minimizing wearer fatigue. In addition, the angled orientation of the cleats also increases traction on harder surfaces.

It must be pointed out at this juncture that while the overboot 20 shown in the drawing herein includes angled cleats which extend the full width of the sole, such a feature is not crucial to the invention. Accordingly, the cleats may extend at the angle for only a portion of the width of the sole and may extend perpendicular to the longitudinal axis for the remainder of the sole's width.

Without further elaboration, the foregoing will so fully illustrate my invention that others may, by applying current or future knowledge, readily adapt the same for use under various conditions of service.

What is claimed as the invention is:

1. A waterproof boot arranged to be worn over other footwear for providing good traction on soft adhering surface materials and for effecting release of said adhering material during walking, said boot being molded as an integral unit of resilient material including an upper portion, a sole portion and heel portion, said sole portion including plural elongated cleats extending across at least a portion of said sole portion, each of said cleats comprising a pair of raised ridges and a first groove therebetween, the space between immediately adjacent cleats forming a relatively wide second groove therebetween, said second groove being substantially smooth between immediately adjacent cleats, said cleats being disposed at a predetermined angle to the longitudinal axis of said sole portion, said angle being approximately equal to the angle made with said axis by a line extending from the second to the fifth metatarsal head of the wearer's foot.

2. The boot of claim 1 wherein each of said ridges is linear, with said linear ridges lying parallel to one another on either side of said first groove, said first groove extending at least a substantial portion of the width of said cleat.

3. The boot of claim 2 wherein each of said cleats comprises plural undulating ridges extending in said first groove between said linear ridges.

4. The boot of claim 3 wherein each of said ridges includes plural serrations.

5. The boot of claim 4 wherein said undulating ridges extend generally parallel to said linear ridges.

6. The boot of claim 5 wherein said heel includes plural elongated wells, each of which extends perpendicularly to said axis.

7. The boot of claim 6 additionally comprising a grit material secured within the first groove in each of said cleats.

8. The boot of claim 1 wherein each of said cleats extends the full width of said sole portion.

9. The boot of claim 8 wherein each of said ridges is linear, with said linear ridges lying parallel to one another on either side of said first groove, said first groove extending the full width of said cleat.

10. The boot of claim 9 wherein each of said cleats comprises plural undulating ridges extending in said first groove between said linear ridges.

11. For use in footwear a sole for providing good traction on soft adhering surface materials and for effecting release of such adhering materials during walking, said sole being molded of resilient material including plural elongated cleats extending across at least a portion of said sole, each of said cleats comprising a pair of raised ridges and a first groove therebetween, the space between immediately adjacent cleats forming a relatively wide second groove therebetween, said second groove being substantially smooth between immediately adjacent cleats, said cleats being disposed at a predetermined angle to the longitudinal axis of said sole, said angle being approximately equal to the angle made with said axis by a line extending from the second to the fifth metatarsal head of the wearer's foot.

12. The sole of claim 11 wherein each of said ridges is linear, with said linear ridges lying parallel to one another on either side of said first groove, said first groove extending at least a substantial portion of the width of said cleat.

13. The sole of claim 12 wherein each of said cleats comprises plural undulating ridges extending in said first groove between said linear ridges.

14. The sole of claim 13 wherein each of said linear ridges includes plural serrations.

15. The sole of claim 14 wherein said undulating ridges extend generally parallel to said linear ridges.

16. The sole of claim 15 additionally comprising a grit material secured within the first groove in each of said cleats.

* * * * *